US005360367A

United States Patent [19]

Ho

[11] Patent Number: 5,360,367

[45] Date of Patent: Nov. 1, 1994

[54] TOY CAR STRUCTURE

[76] Inventor: Tsai W. Ho, No. 82-1, Chung Jen Rd., Sec. 1 Pei Tou Dist., Taipei City, Taiwan, Prov. of China

[21] Appl. No.: 19,639

[22] Filed: Feb. 18, 1993

[51] Int. Cl.[5] ..... A63H 17/26

[52] U.S. Cl. ..... 446/470; 446/288

[58] Field of Search ..... 446/279, 288, 465, 462, 446/470, 457, 409

[56] References Cited

U.S. PATENT DOCUMENTS 4,925,427 5/1990 Wu ..... 446/288 X 5,069,649 12/1991 Wu ..... 446/288

*Primary Examiner*—Mickey Yu

*Attorney, Agent, or Firm*—Morton J. Rosenberg; David I. Klein

[57] ABSTRACT

A toy car is provided which includes a gear train mounted within a gear housing secured to chassis of the toy car. The gear train is driven by a motor which rotates a pair of vertically displaced flywheel members. An arcuately contoured tab member is mounted on an upper surface of one of the flywheel member to slidably engage an elevation rod secured to a simulated helicopter at one end to raised and lower the helicoper. Rotation of the flywheel members also activates a car seat mechanism for moving a pair of car seats simultaneously with the movement of the simulated helicopter.

2 Claims, 4 Drawing Sheets

TOY CAR STRUCTURE

BACKGROUND OF THE INVENTION

In regards to the current toy car market, toy cars having simple movements are not in demand. Therefore, the search for more complex toy car designs has become the major emphasis of the toy car manufacturing industry. However, there are at present many toy cars capable of performing a range of different operational actions and although each such toy car offers unique characteristics, they all still have the common shortcomings of a overly complicated structure and higher production costs. In view of this situation, the inventor of the invention herein has especially designed a kind of toy car that in addition to being capable of normal toy car actions, also carries figurines holding guns and sitting on seats that move inward and outward, and furthermore, features a toy car complete with a trailing helicopter that climbs and descends as the rotors are spinning, thereby presenting consumers even more selection opportunities. Especially noteworthy is that the invention herein utilizes an exceptionally uncomplicated structure to achieve the aforementioned actions, while offering simplified toy car construction and reduced manpower assembly requirements which significantly lowers production costs and raises the practical value of the toy car product.

To enable inspection officials to further understand the finer structural and performance capabilities of the invention herein, the following detailed description of the appended drawings follows below.

DETAILED DESCRIPTION OF THE INVENTION

Figure 1:
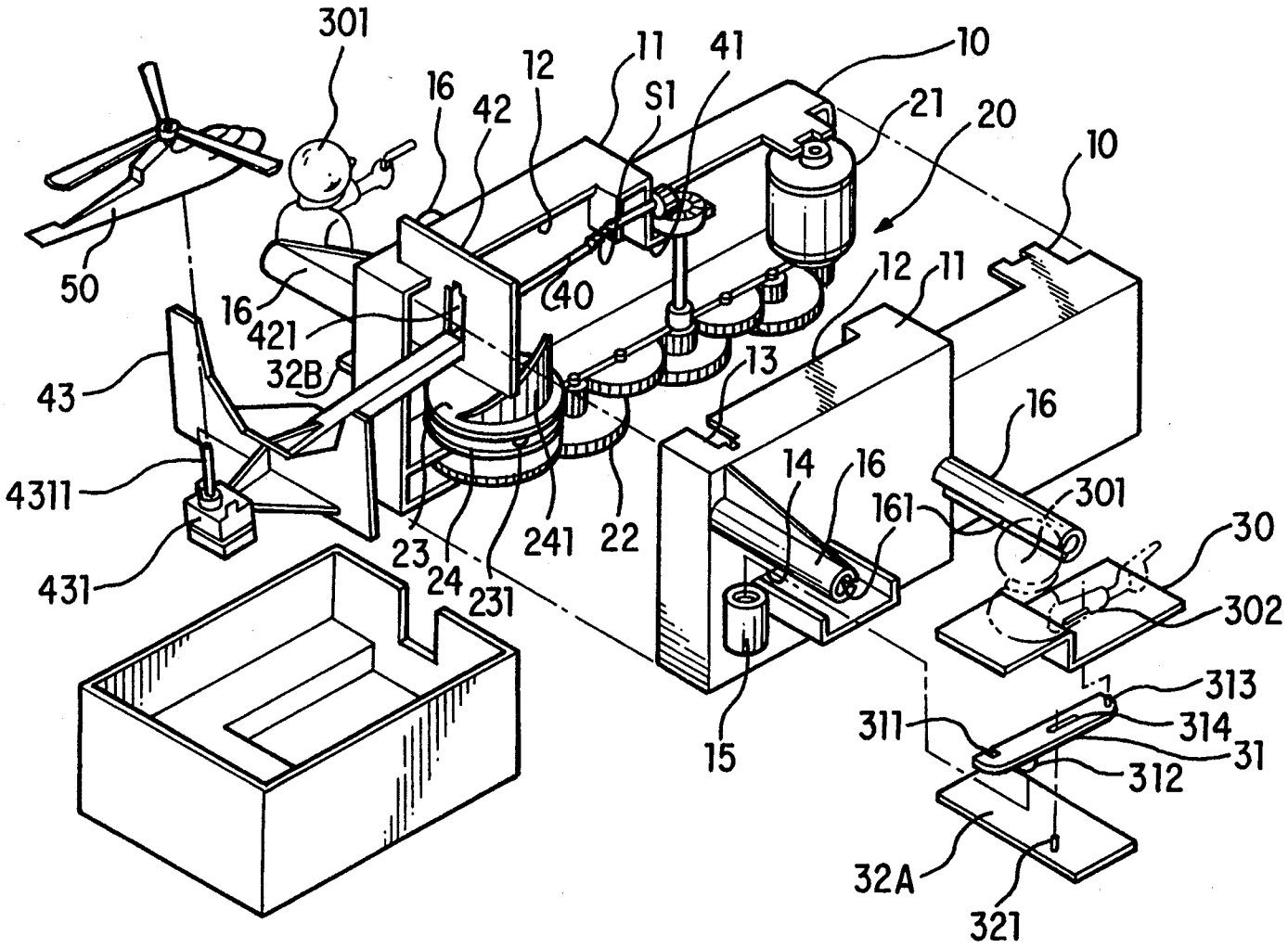
FIG. 1 is an exploded isometric drawing of the main structure the invention herein.

FIG. 1 is an exploded isometric drawing of the invention herein and FIG. 1 illustrates that the main structure of the invention herein includes and is comprised of the drive gear homing (10), a set of drive gears (20), two seats (30), an elevation rod (40), a helicopter (50) and other main components and assemblies; wherein, the aforementioned drive gear homing (10) is installed on the lower chassis (Refer to FIG. 4.) of the car body (5) and consists of two matching halves that are assembled together and with further regard to the aforesaid two matching halves, there is a positioning section (11) for the elevation rod (40) that is located in line with the centered junction where the two matching halves are assembled together, furthermore, on the top of the two assembled matching halves and placed lengthwise along a linear path extending rearward from the positioning section (11 ) to the drive shaft (41) and elevation rod

Figures 2A, 2B:
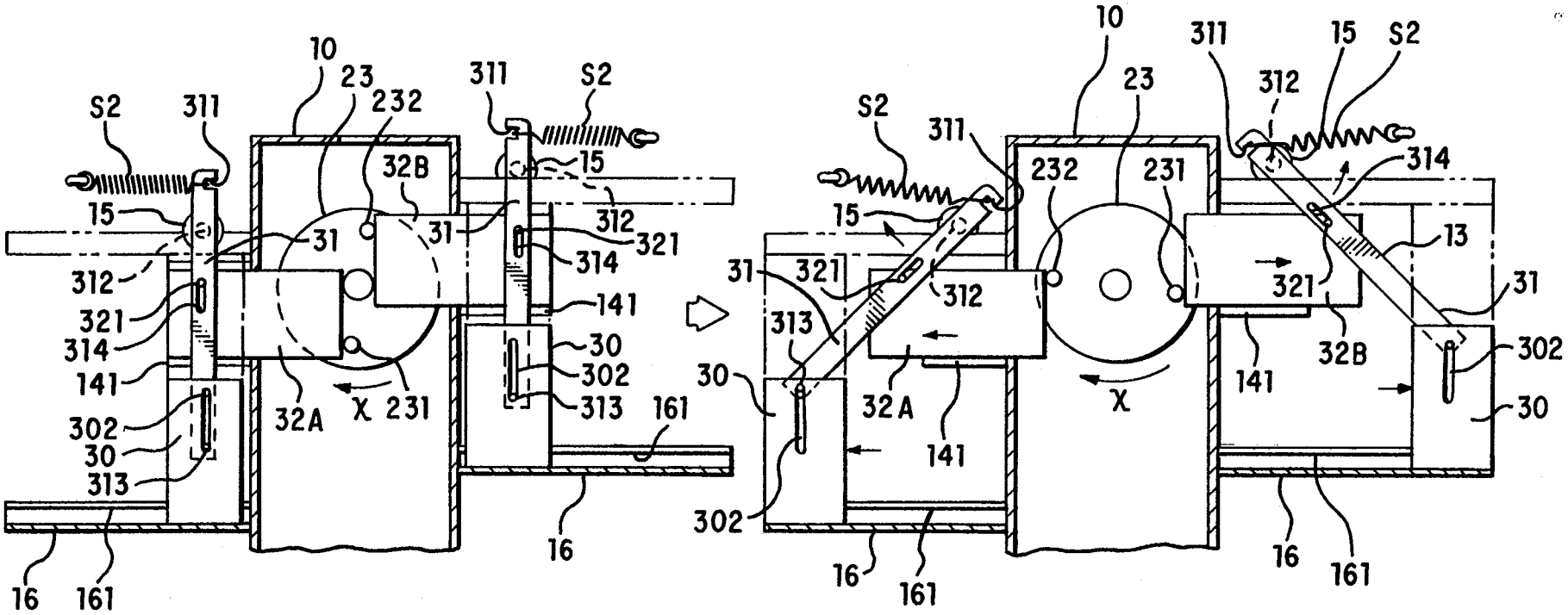
FIG. 2A and FIG. 2B are orthographic drawings of the main structure of the invention herein, from a top view perspective, that illustrate the positional and operational relationship existing between the seats and the respective driving flywheel.
Figure 3:
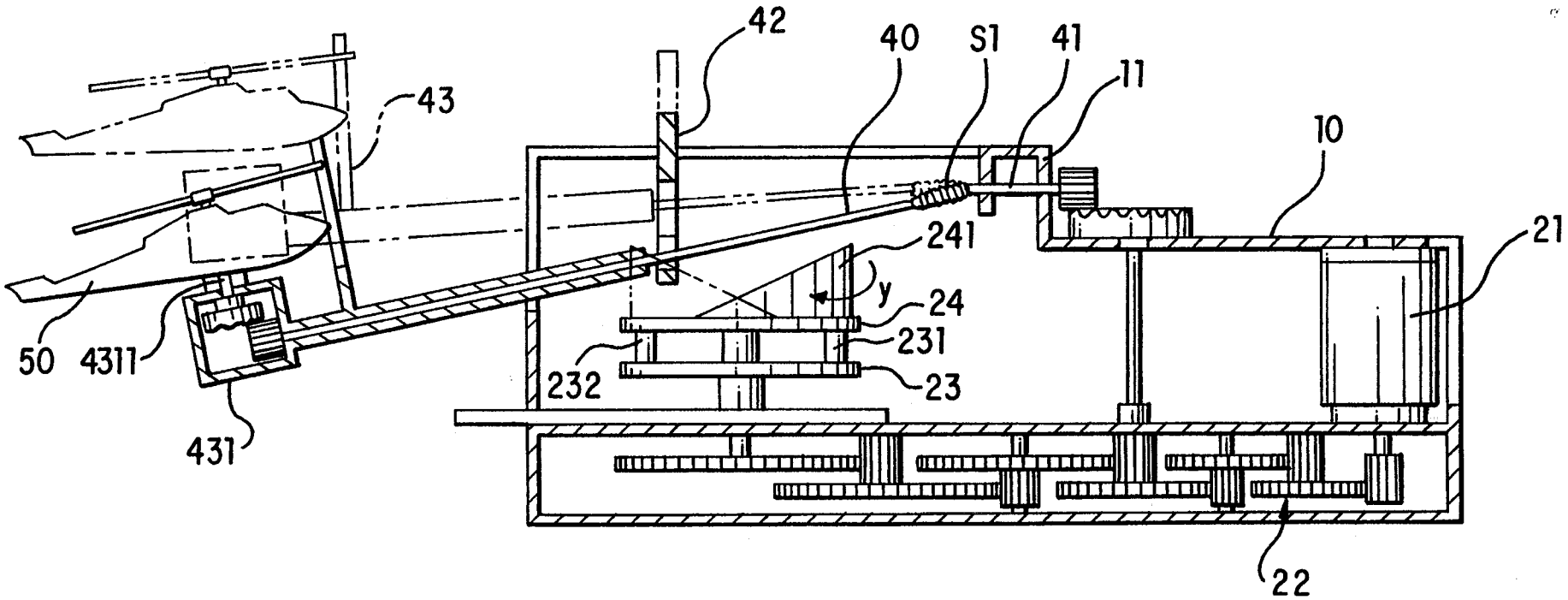
FIG. 3 is an orthographic cross-sectional side view of the invention herein illustrating the positional and operational relationship existing between the elevation plate and the respective driving flywheel.
Figure 4:
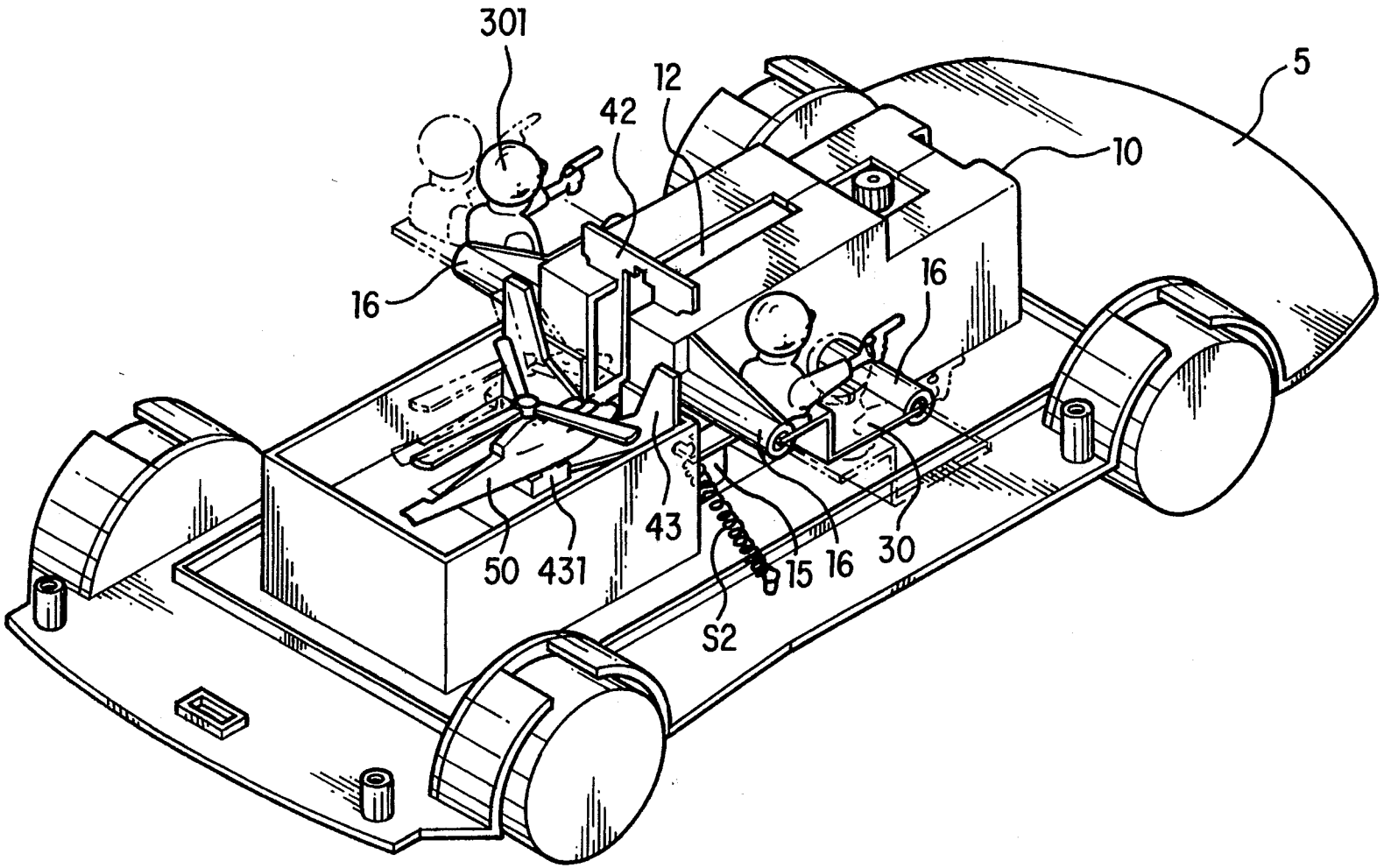
FIG. 4 is an isometric drawing of the invention herein illustrating the action of the main moving components with respect to the body of the toy car.

(40) is a slot (12), with another slot (13), placed at the rearward end and cut perpendicularly to the aforesaid slot (12), that is oriented to a left and right direction; located at a low point on each of the lengthwise side walls of the aforementioned two matching halves is a forward and rearward oriented slot (14) and extending from the bottom edge of the aforesaid slots (14) is a slide channel (141), also on each of the two aforementioned lengthwise side walls at the rear of the aforementioned slots (14) are hinge pin :holders and near the two aforesaid slots (14) are two diagonally placed round hollow columns (16), and through each of the aforesaid round hollow columns (16) is a slot (161 ); and further wherein, the set of drive gears (20) are enclosed in the drive gear housing (10) along with a motor (21) rotating the gear train (22) and the single shaft constructed with dual-level flywheels (23) (24) that moves the two seats (30) inward and outward as well as moves the elevation rod (40) upward, downward and rotating simultaneously; the gear train (22) also powers the wheels under the lower chassis of the toy car (This is conventional technology and is not illustrated in the drawings. The mechanical power transmission and structure of the motor (21) and gear train (22) properly belong to conventionally utilized technology, thus there is no need to describe them in detail); on the upper circumferential surface of the lower-level flywheel (23) of the aforementioned two single-shaft dual-level flywheels (23) (24) are two protruding columns (231) (232) and on the upper circumferential surface of the upper flywheel (24) of the aforementioned single shaft constructed with dual-level flywheels (23) (24) is a curved right-angle triangular tab (241), wherein the two seats (30) each have a hinge plate (31) and a slide plate (32A) (32B) which are moved by the set of drive gears (20); the aforementioned two seats (30) are step-shaped pieces, with a figurine holding a gun (301) sitting on each seat (30) and at the center under the lowest section of each seat is a slot (302) oriented in a forward and rearward direction; the two aforementioned hinge plates (31 ) each have a notch (311) on the inner side, a protruding column (312) on the underside to the rear, a protruding column (313) on the upper surface to the front: and a slot (314) through the center oriented forward and rearward; on each of the aforementioned slide plates (32A) (32B) and angled to the rear of the upper surfaces is a protruding column (321); and further, wherein the slot (12) along and through the top of the drive gear housing (10) accommodates at the front section a drive shaft (41), the elevation plate (42) through which the rod can be inserted through, the U-shaped structure (43) at the rear end of the rod and the helicopter mount (431) formed. with the aforementioned driveshaft (41); the spring (41) at the rear end is attached at the front end of the elevation rod (40) and, furthermore, the spring (S1) is flexible to enable the rotation of the elevation rod (40) even when the elevation rod (40) is being raised and lowered and the spring (S1) is a state of flexion; the aforementioned elevation plate (42) is placed into the slot (13) on top of the drive gear housing (10) and in the center of the elevation plate (42) is a slot (421) through which the elevation rod (40) can be passed; the aforementioned tailpiece (43) at the rear end of the rod is generally V-shaped and behind the aforesaid tailpiece is a helicopter mount (431), with the hole in the top of the helicopter mount (431) extending through the mount and reaching the drive rod (4311) in the elevation rod (40); wherein, the helicopter (50) has a hole through the lower fuselage which extends to the rotor on the upper fuselage such that when the drive rod (4311) is inserted into the helicopter mount (431), the rotor is rotated by the drive rod (4311); FIG. 2A and FIG. 2B of the invention herein illustrates the operational relationship existing between the seats and the flywheel that moves the aforesaid seats; the two slide plates (32A) and (32B) extend into the drive gear housing through slots (14) on the sides of the drive gear housing (10) and are moved by the protruding columns (231) and (232) on surface of the flywheel (23) facing flywheel shaft, furthermore, the width of the two slide plates (32A) and (32B) should be larger than the distance between each of the protruding columns (231) (232) and the flywheel shaft to ensure that the protruding columns (231) (232) are discrete protrusions which move against the sliding plates (32A) (32B) as the flywheel (23) is rotating; furthermore, there are two hinge plates (31) and one hinge plate (31) is placed on each of the aforesaid two slide plates (32A) (32B), wherein the slots (314) in the center of the hinge plates (31) are over the protruding columns (321) on the upper surfaces of the sliding plates (32A) (32B), the protruding columns (312) on the undersides of the hinge plates (31) are inserted into and pivot in the hinge pin holders (15) on each side of the drive gear housing (10) and the notches (311) to the rear and on the inner lateral sides of the hinge plates (31) are utilized to fasten one end of the springs (S2) which are connected to the car body (5) (Refer to FIG. 4.); furthermore, each of the two seats (30) is enslotted in the slot (161) on each of the respective round hollow columns (16) extending from the sides of the drive gear housing (10) and the base of each seat: (30) in contact with the upper surface of the hinge plates (31), wherein the slots (302) in each of the two seats (30) fit onto the protruding columns (313) on the forward upper surfaces of the hinge plates (31); the aforementioned configuration of the components of the invention herein results in the production of motion due to the mechanical relationship of the flywheel (23), slide plates (32A) (32B), hinge plate (31) and the two seats (30); FIG. 2B of the invention herein further illustrates the operational relationship existing between the two seats (30) and the flywheel (23) that drives the two seats (30); when the flywheel (23) rotates (the rotational direction of the flywheel (23) is indicated by arrow X), the protruding columns (231) and (232)respectively positioned on the flywheel (23) surface push the slide plates (32A) and (32B) outward, which then sets the two seats (30) in motion, and following each revolution of 90 degrees by the flywheel (23), the retracting force of the springs (S2) attached to the two hinge plates (31) returns the seats (30) to the original position (the seats are pulled back inward), wherein during the continuous revolution of the flywheel (23), the seats are moved inward and outward in an alternating cycle; as can also be observed in FIG. 2B, the point at the rear end of each hinge plate (31) is the center of rotation and therefore can be utilized to increase the movement distance of the two seats (30); FIG. 3 of the invention illustrates the operational relationship existing between the elevation plate and the flywheel that moves the aforesaid elevation plate, wherein FIG. 3 shows that the elevation plate (42) of the invention herein is positioned immediately above the upper surface of the driving flywheel (24) and, furthermore, the width of the elevation plate (42) should be greater than the diameter of the driving flywheel (24) (Refer to FIG. 1) in order to ensure that the elevation plate (42) can be actuated by the curved right-angle triangular tab (241)protruding from the surface of the driving flywheel (24); FIG. 3 also shows that when the flywheel (24) is rotating (the rotational direction of the flywheel (24) is indicated by arrow y), the initial point of contact between the curved right-angle triangular tab (241) on the rotating flywheel (24) surface and the lower edge of the elevation plate (42) occurs at the lowest point on the edge of the hypotenuse of the curved fight-angle triangular tab (241) and, as the flywheel (24) continues to revolve, the elevation plate (42) is displaced upward to the highest point along the hypotenuse of the curved right-angle triangular tab (241), where the elevation plate (42) then returns to the original position by the weight of the elevation rod (40), and the elevation rod (40) to the helicopter (50) is positioned in a slot on the elevation plate (42) and moves with the rising and falling elevation plate (42); FIG. 4 of the invention herein illustrates the toy car body assembly and the functions; FIG. 4 shows that after the motor (21) is started, since the flywheels (23) and (24) are firmly attached to a common shaft, the flywheels (23) (24) move the seam (30) inward and outward, while also moving the helicopter (50) upward and downward, furthermore, the seats (30) and the helicopter (50) not only move outward to the car door and upward over the car, respectively, as the outward movement of the seats (30) and the upward movement of the helicopter (50) occur, the car doors and the canopy windows also open, however, the capability to open car doors and windows belong to conventionally utilized technology and therefore are not depicted in the drawing; in summary of the aforementioned detailed description, the primary innovation of the invention herein is the offering of a toy car structure capable of unique operation, including seats that move inward and outward, the presence of figurines holding guns, an attached helicopter that moves upward and downward while the rotors are spinning and a realistic military battle-ready appearance; furthermore, the invention herein not only has a low production cost, but is also of high practical value, especially in terms of the thoroughly explained performance examples in the detailed description of the invention herein which can be verified through demonstration to convince inspection officials that the invention herein certainly qualifies as a new invention and is approved as eligible for the granting of all relevant patent rights.

What is claimed is:

1. A toy car having a body, a chassis, a pair of displaceable seat members, and a displaceable simulated helicopter, comprising:

(a) a set of drive gears defining a gear train located within a drive gear housing, said drive gear housing secured to said chassis of said toy car and forming an enclosure for said set of drive gears;

(b) a motor coupled to one of said drive gears for rotatively actuating said gear train;

(c) an upper and lower flywheel member, said upper and lower flywheel members being vertically displaced and axially aligned and having a pair of flywheel column members located on opposing sides of an axis of said flywheel members, said flywheel column members extending vertically and fixedly coupled to said flywheel members on opposing ends of a respective one of said flywheel column members, said pair of vertically displaced flywheel members being coupled by a flywheel shaft to one of said gears of said gear train for responsive rotation therewith, said upper flywheel member having an arcuately contoured right-angle triangular tab member secured to an upper surface thereof;

(d) a pair of slide plate members, each of said slide plate members having one end surface in contiguous contact with a respective flywheel column member for linear reversible displacement responsive to a rotative displacement of said flywheel members, each of said slide plate members having a protruding pin insertable within a slot formed through a respective hinge plate member, said respective hinge plate member having a first end coupled to a hinge plate spring and a second end having a hinge plate pin insertable within a slot formed through a respective displaceable seat member, for reversible transverse displacement of said seat member responsive to said rotation of said flywheel members, and, (e) an elevation rod member extending through a vertically directed slot formed through an elevation plate member displaceably mounted to said drive gear housing, said elevation rod member being rotatively coupled on a first end to one of said gears of said gear train and on a second end to a helicopter gear set coupled to a rotor of said helicopter for responsive rotation thereof.

2. The toy car as recited in claim 1 wherein a lower edge of said elevation plate member slidingly engages said arcuately contoured right-angle triangular tab member responsive to said rotation of said upper flywheel member for vertically displacing said elevation rod member and responsibility vertically displacing said simulated helicopter, said elevation plate member having a width dimension greater than a diameter of said upper flywheel member.

* * * * *